US006196891B1

(12) United States Patent
Jamison

(10) Patent No.: US 6,196,891 B1
(45) Date of Patent: Mar. 6, 2001

(54) YO-YO INCLUDING ADJUSTABLE WEIGHT SYSTEM

(75) Inventor: David S. Jamison, Twinsburg, OH (US)

(73) Assignee: Flambeau Products Corporation, Middlefield, OH (US)

( * ) Notice: Subject to any disclaimer, the term of this patent is extended or adjusted under 35 U.S.C. 154(b) by 0 days.

(21) Appl. No.: 09/444,325

(22) Filed: Nov. 19, 1999

(51) Int. Cl.[7] ..... A63H 1/30
(52) U.S. Cl. ..... 446/250; 446/247
(58) Field of Search ..... 496/236, 247, 496/248, 250

(56) References Cited

U.S. PATENT DOCUMENTS 5,254,027 * 10/1993 Mcavoy, Jr. ..... 446/250
5,951,353 * 9/1999 Moore ..... 446/247
5,984,759 * 11/1999 O'Sullivan ..... 446/250

OTHER PUBLICATIONS

1998 Team Losi, Inc., Revolution Yo–Yo packaging and instructions.

* cited by examiner

*Primary Examiner*—Sam Rimell
(74) *Attorney, Agent, or Firm*—Michael Best & Friedrich LLP

(57) ABSTRACT

A yo-yo includes first and second side members, an axle extending between the side members, a string interconnected with the axle, and at least one weight releasably mounted to one of the side members in a first location, and moveable to a second location.

13 Claims, 2 Drawing Sheets

YO-YO INCLUDING ADJUSTABLE WEIGHT SYSTEM

FIELD OF THE INVENTION

The invention relates to yo-yos, and more particularly to the weight and weight distribution of a yo-yo.

BACKGROUND

Many yo-yo tricks require the yo-yo to spin freely at the end of the string without climbing up the string. A yo-yo spinning freely at the end of the string is commonly said to "sleep" or "dwell." Ideally, a player will cause the yo-yo to sleep, and perform the desired trick while the yo-yo is spinning. After the trick has been executed, the player tugs on the string and the yo-yo climbs up the string again (referred to herein as "waking up" the yo-yo).

The sleep time for a yo-yo will typically increase as the angular momentum of the yo-yo increases. Angular momentum is a function of the rotational speed of the yo-yo and the weight distribution in the yo-yo. It is known to provide a weighted ring that may be mounted on or removed from the yo-yo to alter the yo-yo's angular momentum.

Another factor in performing yo-yo tricks is the weight of the yo-yo. Some tricks are more easily performed with a lighter-weight yo-yo, and some tricks require a heavier yo-yo. Some yo-yo players own several yo-yos of various weights to perform these various tricks.

SUMMARY

It is desirable to provide a yo-yo having an adjustable weighting system that permits several different weight arrangements to accommodate a wide range of yo-yo tricks. Such an adjustable weighting system is also desirable because it permits, to a certain degree, customization of sleep time to fit the skill level of the yo-yo player and the trick sought to be executed. In this regard, a yo-yo having an adjustable weight system may replace several non-adjustable yo-yos.

The present invention provides a yo-yo including first and second side members, an axle extending between the side members, a string interconnected with the axle, and at least one weight releasably attached to at least one of the side members at a first location and movable to a second location on the side member.

A plurality of retainers may be interconnected with the side members, and the weights may be releasably held in place by the retainers at selected locations. Preferably, the retainers include at least one resilient wall such that when the weights are inserted at least partially into the retainers, the resilient wall creates a press-fit connection between the weights and the retainers. Alternatively, the retainers may include hooks, threaded fasteners, clips, or hook-and-loop fasteners. The weights may be arranged in an eccentric weighting pattern, and the pattern of weights may be different in one side member than the pattern in the other side member. The weights are preferably sphere shaped members, such as ball bearings, but the weights may be provided in substantially any shape.

The invention also provides a cover releasably mounted over a cavity in one of the side members. The cover is preferably press-fit over the cavity, and an optional insert may be sandwiched between the cavity and the cover. A tool may be provided having an elongated portion that may be used to pry the cover from the cavity.

One advantage of the present invention is that it permits adjustment of the weight and weight distribution of the yo-yo to modify the yo-yo's angular momentum.

Another advantage of the present invention is that it includes a plurality of retainers in which weights are releasably received such that the weights may be moved from one position to another to adjust the weight distribution.

Another advantage of the present invention is that it provides a cover that extends across the cavity in which the weights are retained, and that may retain a decorative insert.

Other features and advantages of the invention will become apparent to those skilled in the art upon review of the following detailed description, claims, and drawings.

Figure 3:
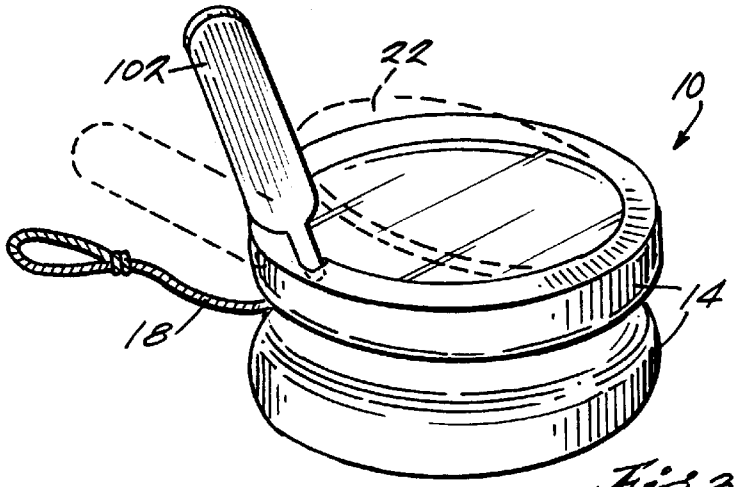
FIG. 3 is a perspective view of the yo-yo shown in FIG. 1 and illustrating how a cover may be removed.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify steps of a method or process is simply for identification and is not meant to indicate that the steps should be performed in a particular order.

DETAILED DESCRIPTION

Figure 1:
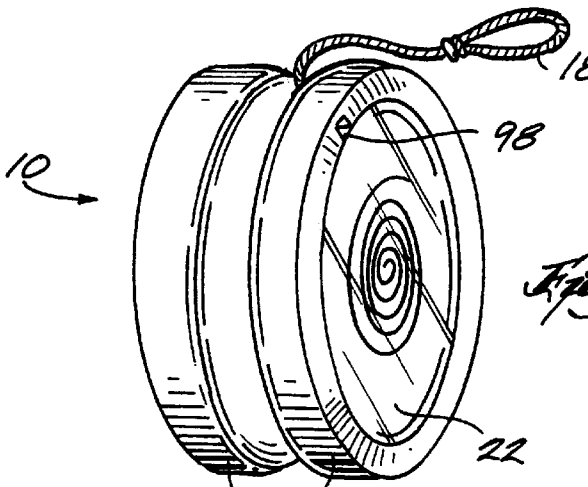
FIG. 1 is a perspective view of a yo-yo embodying the present invention.

FIG. 1 illustrates a yo-yo 10 embodying the invention and including a pair of side members 14 and a string 18. The illustrated yo-yo 10 is an Imperial or tournament style yo-yo, but the invention may alternatively be embodied in a yo-yo of another style, such as a Butterfly style in which the side members 14 are inverted and flare outwardly. As used herein, unless otherwise specified, "yo-yo" encompasses all styles and shapes of yo-yos.

Figure 2:
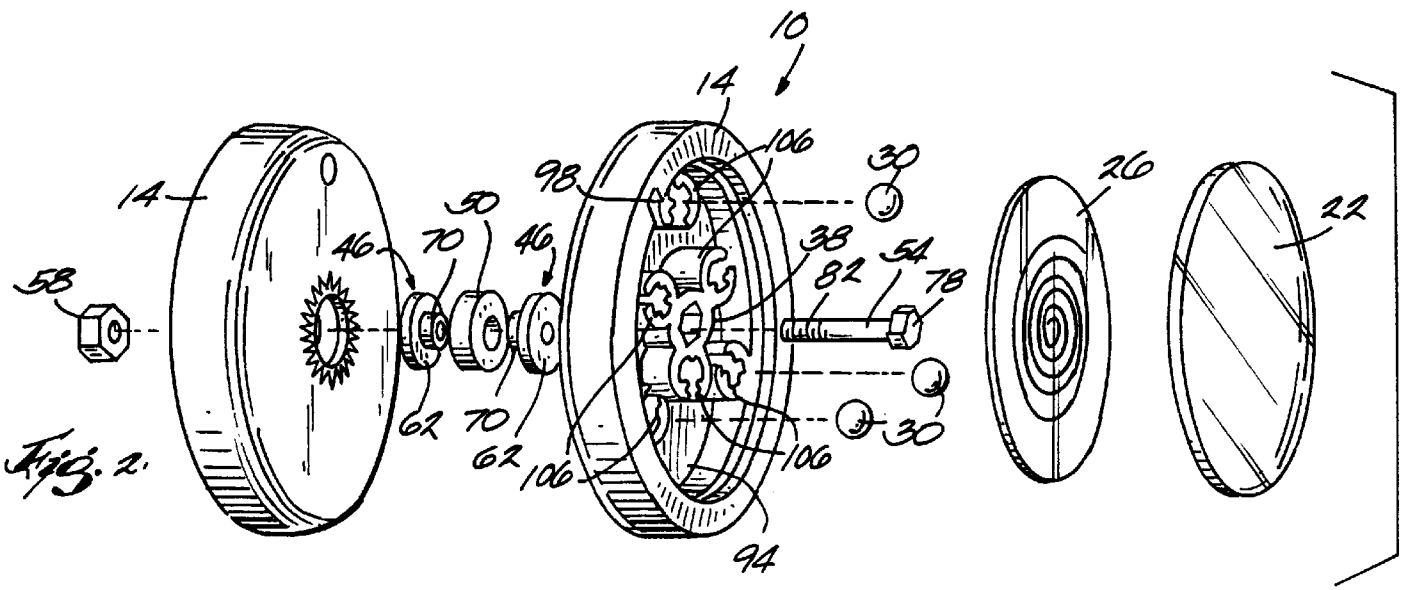
FIG. 2 is an exploded view of the yo-yo of FIG. 1.

FIG. 2 illustrates other components of the yo-yo 10. Each side member 14 has associated therewith a cap or cover 22, an optional insert 26, a plurality of weights 30, and a hub 38. The yo-yo 10 also has a bearing assembly that includes a pair of bearing supports 46 and a bearing 50 supported by the bearing supports 46. An axle 54 extends through the side members 14 and bearing supports 46, and is threaded into a nut 58 to hold the yo-yo 10 together (see also FIG. 4). The illustrated bearing assembly is an optional part of the invention. The string 18 may be interconnected with the axle 54 either through the illustrated bearing assembly, through an alternative bearing assembly, or through direct contact between the string 18 and the axle 54.

Figure 4:
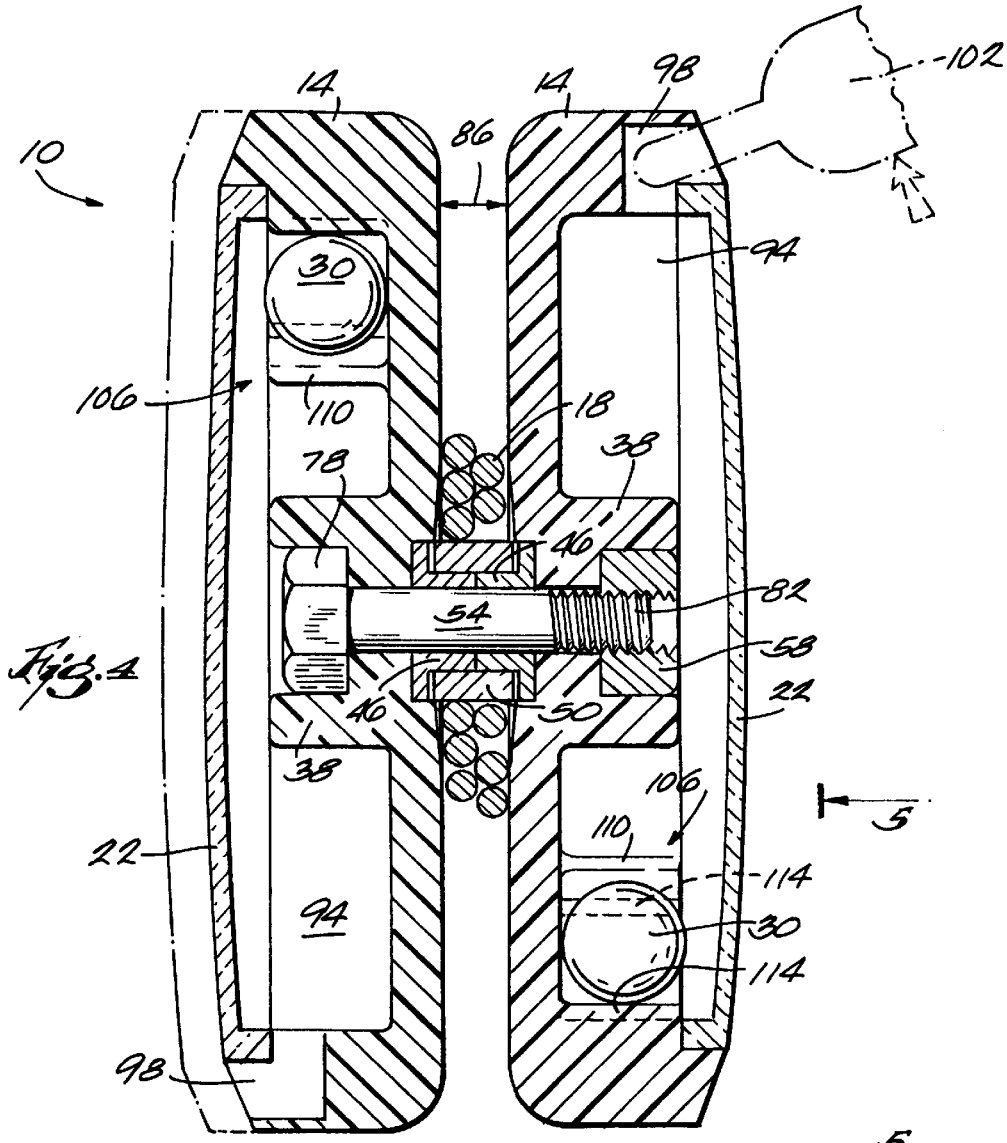
FIG. 4 is a cross-section view of the yo-yo shown in FIG. 1.
Figure 6:
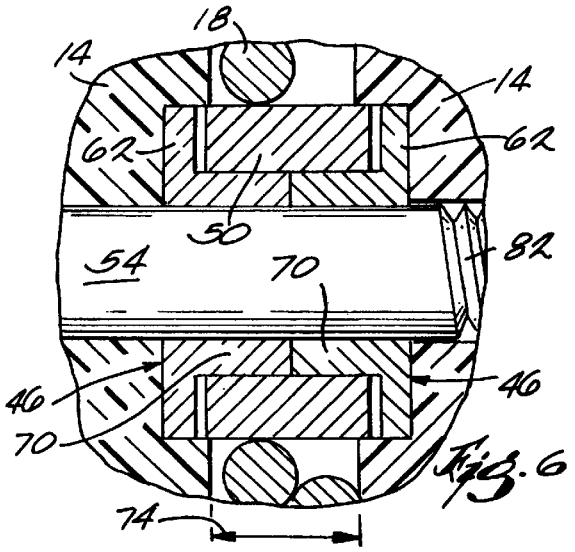
FIG. 6 is an enlarged view of a portion of FIG. 4.

With additional reference to FIGS. 4 and 6, the bearing supports 46 include base portions 62 and insert portions 70 of reduced diameter that extend away from the base portions 62. The bearing width 74 is slightly smaller than the combined lengths of the insert portions 70, and the bore through the bearing 50 is of slightly larger diameter than the outer diameter of the insert portions 70 to promote low friction rotation of the bearing 50 on the bearing supports 46.

As seen in FIGS. 2 and 4, the illustrated axle 54 is a bolt having a head 78 with flats at one end, and a threaded portion 82 at the opposite end. The hub 38 of one of the side members 14 may include flats such that the bolt head 78 does not rotate with respect to the hub 38 when received therein. The nut 58 may be positioned within the hub 38 of the other side member 14 such that the nut 58 does not rotate with respect to the hub 38. In this regard, the head 78 and nut 58 are rotationally fixed with respect to the respective side members 14. Alternatively, the axle 54 may be a threaded stud that is integrally formed with or permanently affixed to one of the side members 14. As an alternative to using the nut 58, the axle 54 may be threaded directly into a threaded bore in the other side member 14. Alternatively, the axle 54 may be press-fit into the other side member 14 instead of threaded.

Referring to FIG. 4, the spacing 86 between the side members 14, also known as "string gap," may be adjusted by relative rotation between the side members 14, causing the side members 14 to be drawn closer together or moved farther apart due to the threads 82. The side members 14 may thus be moved from the position shown in solid lines in FIG. 4 to the position shown in phantom. The smaller the string gap, the easier it becomes to wind the string 18 on the bearing 50. The string gap 86 thus at least partially affects the ease with which the yo-yo 10 may be made to sleep and wake up.

Referring to FIGS. 2 and 3, the covers 22 may be transparent, translucent, colored or opaque, and extend over a cavity 94 in the side members 14. The covers 22 are secured over the cavities 94 by a pressure fit, but may alternatively be fastened, snap-fit, or secured over the cavities 94 in any suitable manner. Each side member 14 includes a recess 98 extending under the cover 22 associated therewith. A tool 102 may be provided having a narrow or elongated portion that is insertable into the recesses 98 to pry the covers 22 out of the cavities 94 with the motion shown in FIGS. 3 and 4. The optional inserts 26 may be pieces of paper, plastic, "pogs" displaying a popular character or person, or other material bearing a design or picture. The inserts 26 are trapped in the cavities 94 by the covers 22.

The illustrated weights 30 are sphere-shaped weights, such as steel ball bearings. However, the weights 30 may be provided in substantially any shape. It is preferred that the weights 30 be discrete units that may be positioned at various positions within the cavities 94. Each weight 30 has its own center of gravity, and is positionable within the cavities 94 such that the weight 30 center of gravity is not on the yo-yo's axis of rotation (i.e., the weight 30 center of gravity is not on the axle 54).

Figure 5:
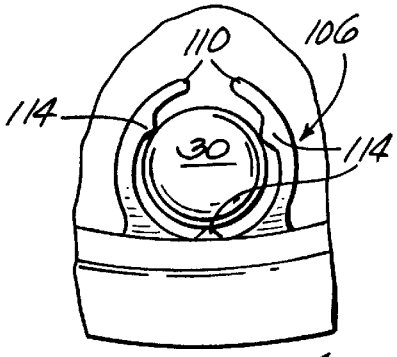
FIG. 5 is a view taken along line 5—5 in FIG. 4.

Turning now to FIGS. 2, 4, and 5, the illustrated cavities 94 include a plurality of retainers 106. The illustrated retainers 106 include walls 110 extending longitudinally outwardly from the side members 14. The thickness and material (e.g., plastic or thin aluminum or steel) of the walls 110 causes the walls 110 to be substantially resilient. The walls 110 flex to permit the weights 30 to be pressed into the retainers 106, and provide a bias radially inward to hold the weights 30 within the retainers 106. Protrusions 114 (FIG. 5) may be used to ensure that the weights 30 are held within the retainers 106 by compression on three sides. In this regard, the weights 30 may be press-fit at least partially within the retainers 106 to hold the weights 30 at selected locations within the cavities 94. The tool 102 may be used to remove the weights 30 from the retainers 106.

It should be noted that, although the illustrated adjustable weight system includes retainers 106 having resilient walls 110, other retainers are contemplated and are considered within the scope of the invention. For example, the retainers may include hooks onto which the weights are mounted, threaded fasteners or clips securing the weights 30 within the cavities 94, or hook-and-loop fasteners (e.g., Velcro). The retainers 106 themselves may be movable in alternative embodiments, and may alternatively be formed integrally with the weights 30 and movable with the weights.

In the illustrated embodiment shown in FIG. 2, there are three retainers 106 at a relatively large radial distance from the axle 54, and three retainers 106 at a relatively small radial distance from the axle 54. The weights 30 may be inserted into all of the retainers 106, or only selected retainers 106. Some of the weights 30 may be inserted into the retainers 106 that are at the large radial distance from the axle 54, and some may be inserted into the retainers at the small radial distance from the axle 54. Customized combinations and patterns of weights including eccentric weighting arrangements may also be created. Also, the number and pattern of weights 30 on one side member 14 may be different from the number and pattern of weights 30 on the other side member 14.

What is claimed is:

1. A yo-yo comprising:

a first side member;

a second side member, one of said first and second side members including a cavity;

an axle extending between said first and second side members;

a stirring interconnected with said axle; and at least one weight releasably attached to said one of said side members within said cavity at a first location, and selectively movable to a second location on said one of said side members; and a cover releasably mounted over said cavity and said weight.

2. The yo-yo of claim 1, wherein said at least one weight includes at least one sphere shaped weight.

3. The yo-yo of claim 1, further comprising a plurality of retainers interconnected with said one of said side members, said weight being releasably attached to said one of said side members with a first retainer at said first location and being removable from said first retainer and releasably attachable to another of said retainers at said second location.

4. The yo-yo of claim 3, wherein said retainers include at least one substantially resilient wall, and wherein said weight is attached to one of said retainers by deflecting said resilient wall of said retainer and at least partially inserting said weight into said retainer.

5. The yo-yo of claim 1, further comprising a plurality of retainers interconnected with each of said side members, wherein said at least one weight includes a plurality of weights releasably attached to said retainers and arranged in a first pattern in one of said side members and a second pattern in the other of said side members, said first and second patterns being changeable by removing selected weights from selected retainers and attaching said selected weights to other selected retainers.

6. The yo-yo of claim 5, wherein said first pattern is different from said second pattern.

7. The yo-yo of claim 5, wherein at least one of said first and second patterns creates an eccentric weight distribution with respect to said axle.

8. The yo-yo of claim 1, wherein said side members each include a plurality of retainers arranged at a first radial distance from said axle and a plurality of retainers arranged at a second radial distance form said axle, and wherein said at least one weight includes a plurality of weights releasably attachable to said retainers such that said weights may be releasably attached to said side members at selected radial distances with respect to said axle.

9. A yo-yo comprising:

first and second side members, at least one of said side members defining a cavity and defining a recess;

a removable weight mounted within said cavity;

an axle extending between said first and second side members;

a string interconnected with said axle;

a cover releasably mounted over said cavity and said weight; and a tool having an elongated portion insertable into said recess to pry said cover from said cavity.

10. The yo-yo of claim 9, wherein said cover is press fit over said cavity.

11. The yo-yo of claim 9, further comprising an insert sandwiched between said cavity and said cover, said insert including an ornamental design.

12. A yo-yo comprising:

a first side member;

a second side member;

an axle extending between said first and second side members;

a string interconnected with said axle;

at least one weight releasably attached to at least one of said side members at a first location, and selectively movable to a second location on said one of said side members; and a plurality of retainers interconnected with said one of said side members, said weight being releasably attached to said one of said side members with a first retainer at said first location and being removable from said first retainer and releasably attachable to another of said retainers at said second location;

wherein said retainers include at least one substantially resilient wall, and wherein said weight is attached to one of said retainers by deflecting said resilient wall of said retainer and at least partially inserting said weight into said retainer.

13. A yo-yo comprising:

a first side member;

a second side member;

an axle extending between said first and second side members;

a string interconnected with said axle;

a plurality of retainers arranged at a first radial distance from said axle on each of said first and second side members, and a plurality of retainers arranged at a second radial distance from said axle on each of said first and second side members; and a plurality of weights releasably attached to said retainers such that said weights may be releasably attached to said side members at selected radial distances with respect to said axle.

* * * * *

UNITED STATES PATENT AND TRADEMARK OFFICE

CERTIFICATE OF CORRECTION

PATENT NO. : 6,196,891 B1
DATED : March 6, 2001
INVENTOR(S) : David S. Jamison

It is certified that error appears in the above-identified patent and that said Letters Patent is hereby corrected as shown below:

Claim 1,
Line 37, delete "stirring" and insert -- string --

Claim 8,
Line 7, delete "form" and insert -- from --

Signed and Sealed this

Fourth Day of December, 2001

*Attest:*

Nicholas P. Godici

*Attesting Officer*

NICHOLAS P. GODICI
*Acting Director of the United States Patent and Trademark Office*